US007774938B2

(12) United States Patent
Friese

(10) Patent No.: US 7,774,938 B2
(45) Date of Patent: Aug. 17, 2010

(54) METHOD OF PRODUCTION A TIRE RIM HAVING DIFFERENT WALL THICKNESSES

(75) Inventor: Udo Friese, Ahlen (DE)

(73) Assignee: WF-Maschinenbau und Blechformtechnik GmbH & Co. KG, Sendenhorst (DE)

( * ) Notice: Subject to any disclaimer, the term of this patent is extended or adjusted under 35 U.S.C. 154(b) by 1249 days.

(21) Appl. No.: 10/531,424

(22) PCT Filed: Sep. 6, 2003

(86) PCT No.: PCT/EP03/09912

§ 371 (c)(1),
(2), (4) Date: Oct. 17, 2005

(87) PCT Pub. No.: WO2004/035243

PCT Pub. Date: Apr. 29, 2004

(65) Prior Publication Data

US 2006/0123629 A1 Jun. 15, 2006

(30) Foreign Application Priority Data

Oct. 17, 2002 (DE) ..... 102 48 356

(51) Int. Cl.
*B23P 17/00* (2006.01)

(52) U.S. Cl. ..... 29/894.325; 29/894; 29/894.324; 72/84

(58) Field of Classification Search ..... 29/894.324, 29/894.325; 72/84
See application file for complete search history.

(56) References Cited

U.S. PATENT DOCUMENTS

| | | | | |
|---|---|---|---|---|
| 2,185,347 | A | 1/1940 | Jeune | |
| 3,364,550 | A | 1/1968 | Jessee et al. | |
| 4,185,370 | A | 1/1980 | Evans | |
| 5,212,866 | A | 5/1993 | Wenzel et al. | |
| 5,740,609 | A * | 4/1998 | Jurus | 29/894.324 |

FOREIGN PATENT DOCUMENTS

| | | | |
|---|---|---|---|
| DE | 26 47 464 | A1 | 4/1978 |
| DE | 29 45 764 | A1 | 5/1981 |
| DE | 197 27 599 | A1 | 1/1999 |
| DE | 199 24 062 | A1 | 12/1999 |
| DE | 102 04 054 | C1 | 4/2003 |
| EP | 1 181 119 | B1 | 2/2002 |
| WO | WO 96/25257 | A1 | 8/1996 |

OTHER PUBLICATIONS

Hideyasu, "Production of Wheel Rim", Patent Abstract of Japan, Pub. No. 59185532, Pub. Date Oct. 22, 1984.

* cited by examiner

*Primary Examiner*—Rick K Chang
(74) *Attorney, Agent, or Firm*—Barnes & Thornburg LLP

(57) ABSTRACT

Thus, the present disclosure includes a method of producing a weight-optimized pneumatic tire rim having rotationally-symmetrically partially different wall thickness. The steps include: providing a tube section having a first wall thickness and two end sides; leveling the first wall thickness starting from the two end sides over a defined rotationally-symmetrical area thereby forming two flanks by precontouring, each of the flanks having a second wall thickness, and pushing tolerance-caused excess material of the flanks into a well base zone between the two flanks; and contouring the flanks by pressure rolling while drawing each of the flanks toward an end area of each of the flanks and reducing the thickness of each of the flanks partially differently to predetermined measurements. The present disclosure also includes a device to implement the method.

11 Claims, 5 Drawing Sheets

METHOD OF PRODUCTION A TIRE RIM HAVING DIFFERENT WALL THICKNESSES

BACKGROUND AND SUMMARY

The present disclosure relates to a method of producing a weight-optimized pneumatic tire rim as well as to a device for implementing the method.

For producing a pneumatic tire rim, it is known, for example, from German Patent Document DE-OS 26 47 464 to reduce the thickness of the outlet wall and that of the tube section, while simultaneously extending the length, on a longitudinally welded cylindrical tube section, which is also called a tire. This is done by pressing on at least one rotating pressure roller or drawing roller in correspondence with a tool lining, which results in partially different wall thicknesses over rotational symmetrical areas and-which wall thicknesses are defined by the function.

Thus, normally, the rim dish is welded together with the rim well in the area of a well base, for which the latter has to have a certain wall thickness.

Because of required weight optimizations, the areas which, in contrast to the above-mentioned welding area, are subject to no special stress, should be constructed as thin as possible. That is so that the original wall thickness, in the case of the finished pneumatic tire rim, exists only in the above-mentioned stressed areas, and is correspondingly reduced by extrusion molding.

However, this is connected with a number of problems. Thus, for example, several working steps are required for achieving the reduction of the wall thickness, which leads to relatively high manufacturing times and resulting high manufacturing costs.

In this case, it is a contributing factor that the edges of the flanks become "uneven" as a result of the extrusion or the drawing of the material. That is, an edge is created which, in the broadest sense, is frayed and requires a finishing.

Particularly in view of the fact that such pneumatic tire rims are produced as serial products in large piece numbers, the above-mentioned problems have a special significance.

The present disclosure relates to a method of producing a pneumatic tire rim such that manufacturing times are shortened and a more cost-effective manufacturing therefore becomes possible.

Thus, the present disclosure includes a method of producing a weight-optimized pneumatic tire rim having rotationally-symmetrically partially different wall thickness. The steps include: providing a tube section having a first wall thickness and two end sides; leveling the first wall thickness starting from the two end sides over a defined rotationally-symmetrical area thereby forming two flanks by precontouring, each of the flanks having a second wall thickness, and pushing tolerance-caused excess material of the flanks into a well base zone between the two flanks: and contouring the flanks by pressure rolling while drawing each of the flanks toward an end area of each of the flanks and reducing the thickness of each of the flanks partially differently to predetermined measurements. The present disclosure also includes a device including a tool lining having one or more of a precontour and a contour, the tool lining having a first lining part and a second lining part, which lining parts are movable relative to one another in an axial direction.

As a result of known manufacturing processes, the tube section used as a blank has relatively large tolerances in its wall thickness which, during the extrusion to a defined wall thickness of the flanks, may lead to unevenness of the edges.

In accordance with the present disclosure, an exact predefinable material volume is created which is available for further machining of the flanks, including longitudinal drawing, contouring and bringing to a predefined wall thicknesses.

The longitudinal drawing, which is the result of possible partial reduction of the wall thickness carried out by pressure rollers, is limited by a stop which is provided in a surrounding manner at a surface area of the tool lining and on which the respective flank rest in an end position, after termination of the pressure rolling.

By the volume of the flanks, which is present in a defined manner after the pressure rolling, the length of the flanks after the termination of the deformation can also be determined while taking into account the desired wall thicknesses.

This allows not only a production of the rim well which is as precise as possible with respect to desired measurements, but subsequent trimming of the edges can also be eliminated because, in the case of each rim well to be produced as a serial product, the same flank volumes exist after the first process step.

The excess material, which results from the thickness tolerances, is pushed into the well base zone during the leveling of the wall thickness, where it leads to a thickening of the wall.

Thus, as the initial wall thickness of the tube section, a wall thickness can be selected which is less than the end wall thickness in the area of the well base zone whose end thickness is, in turn, obtained from the original wall thickness and the added tolerance material of the flanks.

According to an embodiment of the present disclosure, it is provided that, before the leveling of the wall thickness of the then still cylindrical wall section as an initial product, the cylindrical wall section is widened on one or more of the end sides.

In this case, the diameter of the cylindrical tube section is smaller than the largest outside diameter of the rim well to be produced by the subsequent machining steps, whereas the diameter of the tube section corresponds to the largest diameter of the rim well when the end-side widening is terminated.

Since the material volume remains the same in each embodiment, in the case of a smaller diameter of the tube section, a larger width or wall thickness of the tube section is provided.

The above-mentioned widening of the tube section has manufacturing-related advantages since, during the subsequent pressing for the contouring, an uncontrolled excursion of the end areas is prevented.

A device for implementing the above-described method is constructed such that, for receiving the cylindrical tube section, a two-part tool lining is provided. The tool lining is contoured at its outer surface area, the two tool lining parts being axially movable relative to one another.

Other aspects of the present disclosure will become apparent from the following descriptions when considered in conjunction with the accompanying drawings.

DETAILED DESCRIPTION

Figure 1:
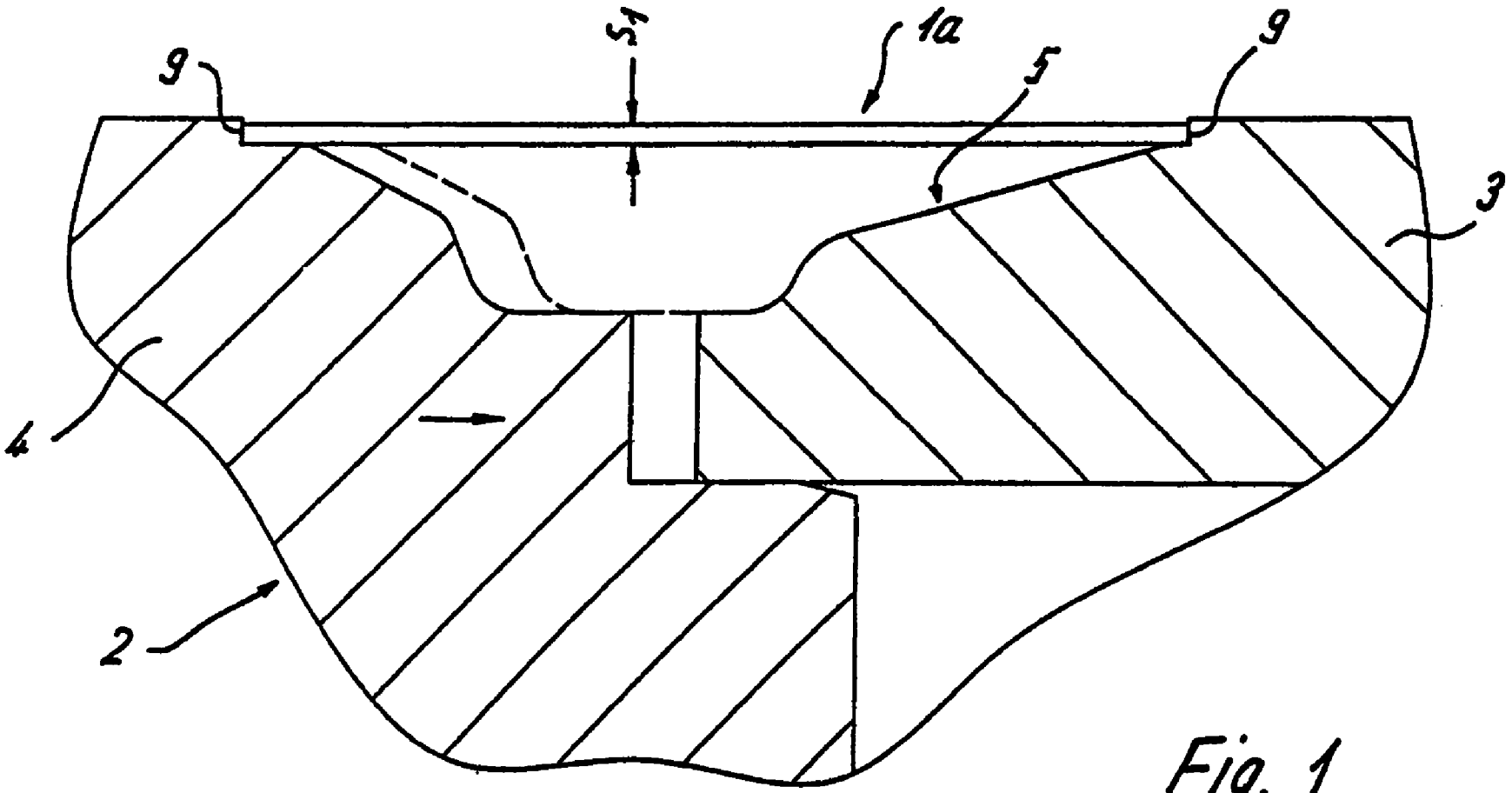
FIGS. 1 and 2 are longitudinal sectional views of a device for producing a pneumatic tire rim illustrating a process step, according to the present disclosure.
Figure 2:
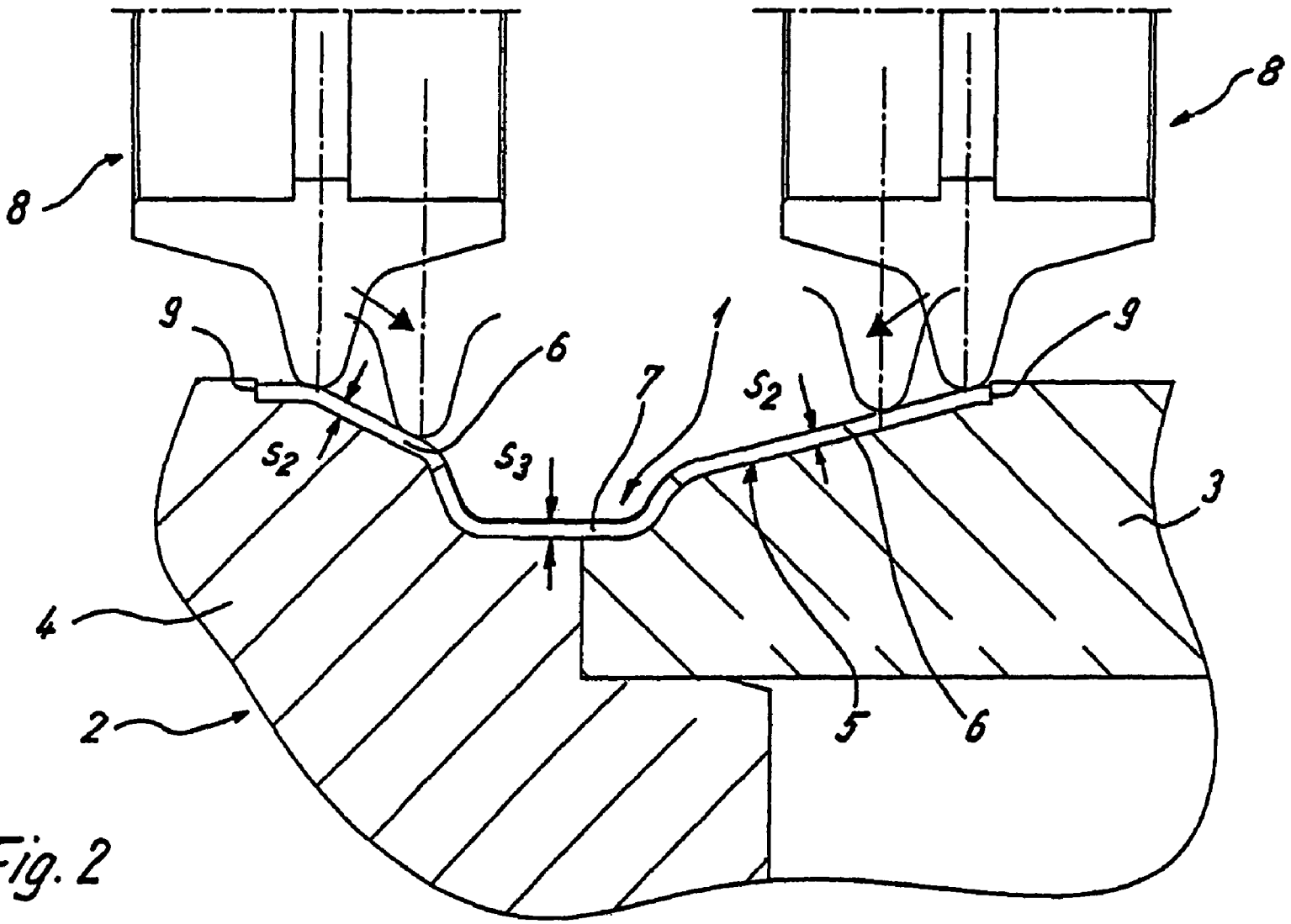

FIGS. 1 and 2 show a device for producing a weight-optimized pneumatic tire rim. A rim well 1 with rotationally symmetrically partially different wall thicknesses is provided from a cylindrical tube section 1*a*. The tube section 1*a* may be made of steel, by cold forming. Rim well 1 is subsequently connected, for example by welding, with a rim dish (not shown).

The rim producing device has a tool lining 2 including a first lining part 3 and a second lining part 4, which lining devices 3, 4 can be moved in an axial direction relative to one another in a spring-loaded manner.

A surface area of the tool lining 2 is provided with a precontour 5. A cylindrical tube section 1*a* can be correspondingly pressed onto the precontour 5 by pressure rollers or rolling tools 8.

FIG. 1 shows the start of a process during which the cylindrical tube section 1*a* rests on an exterior side against the tool lining 2.

Starting from two end sides 13, 14 of the tube section 1*a*, and using the pressure rollers 8, tolerance-caused excess material of a rotationally symmetrical area forms a flank 6. Wall thickness S1 is leveled and displaced in an area of a rim or well base zone 7. On both sides of rim well base zone 7 the formed flanks 6 extend, with each flank 6 having the same wall thickness S2. Well base zone 7, as well as the flanks 6, assume the shape predetermined by the precontour 5.

The tolerance-caused excess material leads to a thickening of a wall thickness S3 of the well base zone 7 with respect to the original wall thickness S1. In the area of the flanks 6, the wall thickness S1 is leveled to such an extent that it corresponds, for example, to a lower tolerance measurement.

As an example, a thickness of 3.5±0.1 as the initial wall thickness S1 of the tube cylinder 1*a*, may result in the wall thickness S2 of the flanks 6 being 3.4, while the wall thickness S3 of the well base zone 7 may be approximately 3.85. The leveling of the wall thickness in the area of the flanks 6 has led to a thickening of the wall thickness S3 of well base zone 7 in comparison to the original wall thickness S1.

In order to hold the tube section 1*a* in an axial direction and in order to prevent an axial drawing from taking place during a rolling, the first lining part 3 and second lining part 4 have a surrounding stop 9. Tube section 1*a* and, in the course of the process, rim well 1 are supported on an end side by stop 9.

Corresponding to a shortening of the length of the tube section 1*a* by the precontour 5, the second lining part 4 is loaded by a spring force (not shown) until it reaches an end position 15, as suggested in FIG. 1 by a broken line and as shown in FIG. 2.

Figure 3:
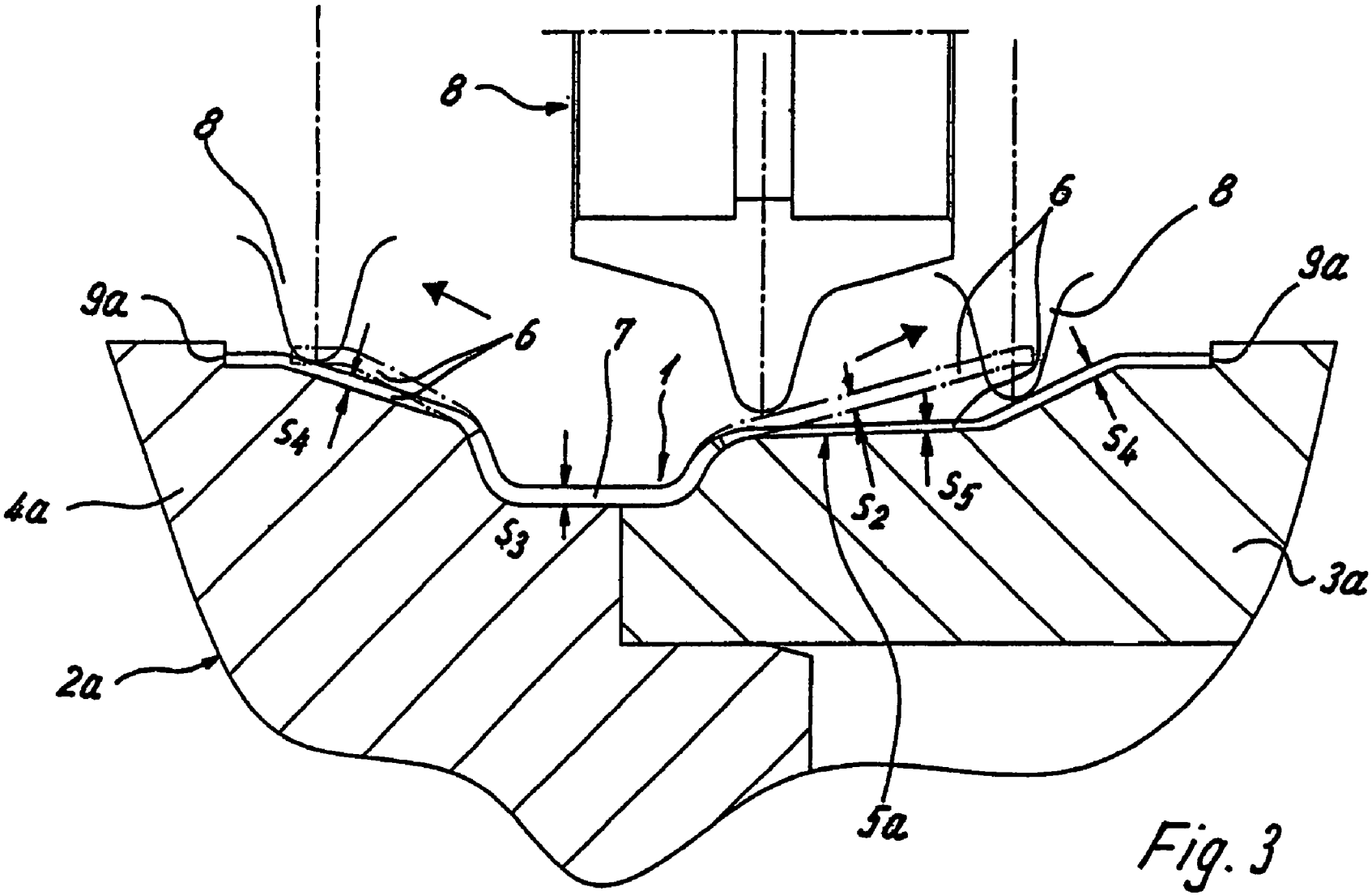
FIGS. 3 and 4 are longitudinal sectional views of another device for process steps for producing a pneumatic tire rim, according to the present disclosure.

In a process step, the flanks 6 are further contoured by a drawing toward the outside, as illustrated in FIG. 3.

Another tool lining 2*a* is shown in FIG. 3. Tool lining 2*a* includes first and second lining parts 3*a* and 4*a*, respectively, in comparison to the first and second lining parts 3 and 4, respectively, of FIGS. 1 and 2. First and second lining parts 3*a* and 3*b* have a changed and drawn course of contour 5*a*. The phantom lines shown in FIG. 3 represent the status of tube section 1*a* from the process step of FIGS. 1 and 2.

By the rim producing device shown in FIG. 3, which has at least one pressure roller 8, different wall thicknesses of the flanks 6 can be produced.

While a longitudinal drawing is carried out, one of the two flanks 6L, starting from the well base zone 7, is changed to a wall thickness S4 by the pressure roller 8 which presses from the inside toward the outside, and which wall thickness may, for example, be 2.6 as compared to a previous measurement of 3.5±0.1.

However, the opposite flank 6R is drawn to such an extent that a rotationally symmetrical area with a wall thickness of also S4=2.6 and having another area with a wall thickness of S5=1.8.

On an end side, deformation of the flanks 6L and 6R is limited by stops 9*a*, which are provided in a surrounding manner at the first and second lining parts 3*a* and 4*a*, respectively, and each stop 9*a* form an end of the contour 5*a*.

A volume, which can be precisely determined beforehand by the leveling of the flanks 6L and 6R, is found in the axial dimension, which is greater in comparison, and in the partially reduced wall thickness.

A height of the rim well 1 and wall thicknesses of the flanks 6L and 6R can be precisely predefined.

Figure 4:
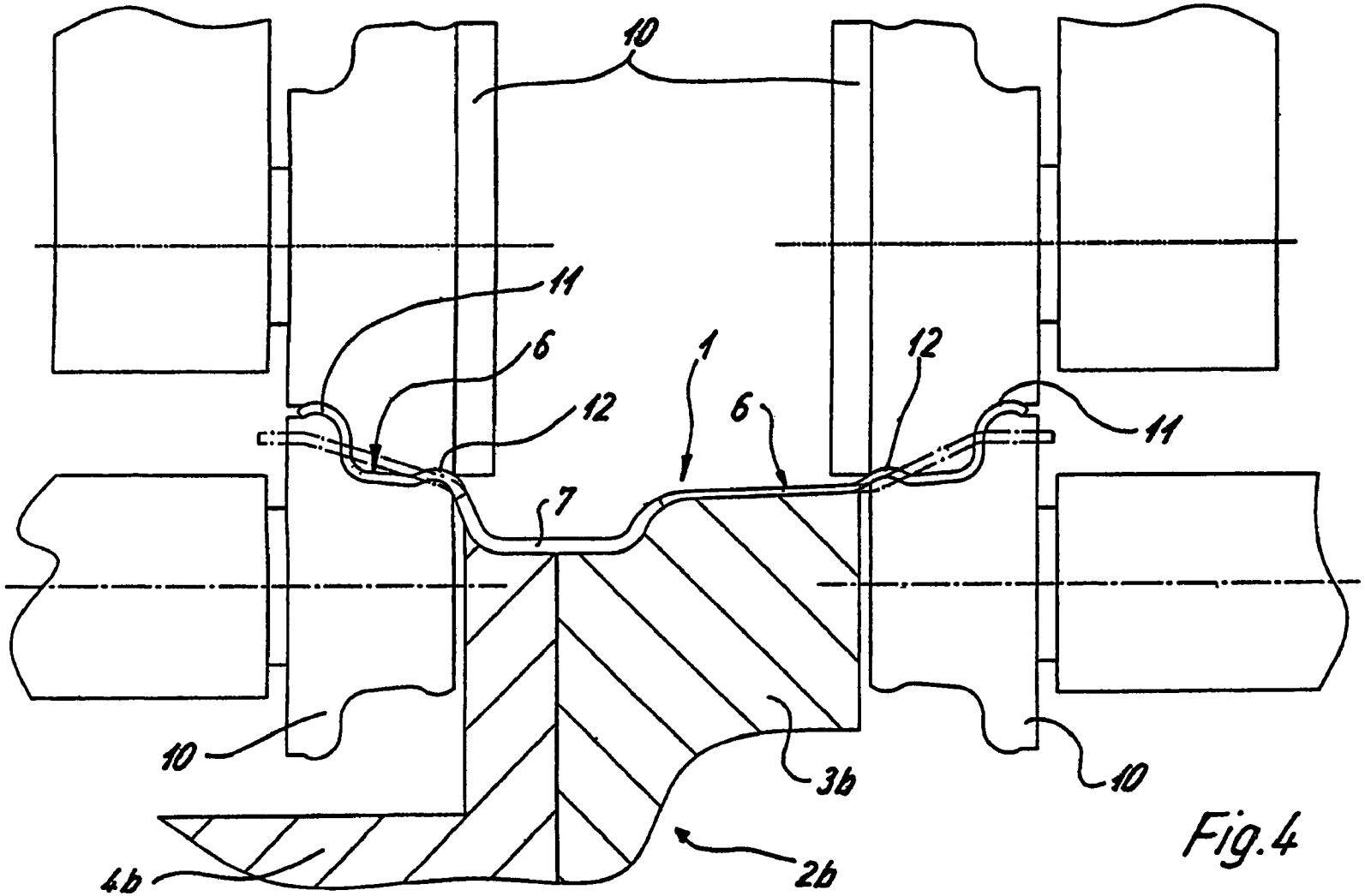

In a subsequent further machining of the rim well 1, as illustrated in FIG. 4, end areas 16, 17 of the flanks 6 are finished by shaping rollers 10. In a known manner, surrounding rim flanges 11 and humps 12 are shaped on and are used for receiving a tire (not shown).

A tool lining 2*b* is provided, as shown in FIG. 4. Tool lining 2*b* includes a first lining part 3*b* and a second lining part 4*b*, having, on their exterior sides, are at least partially shaped to correspond to the contour of the rim well 1.

Figure 5:
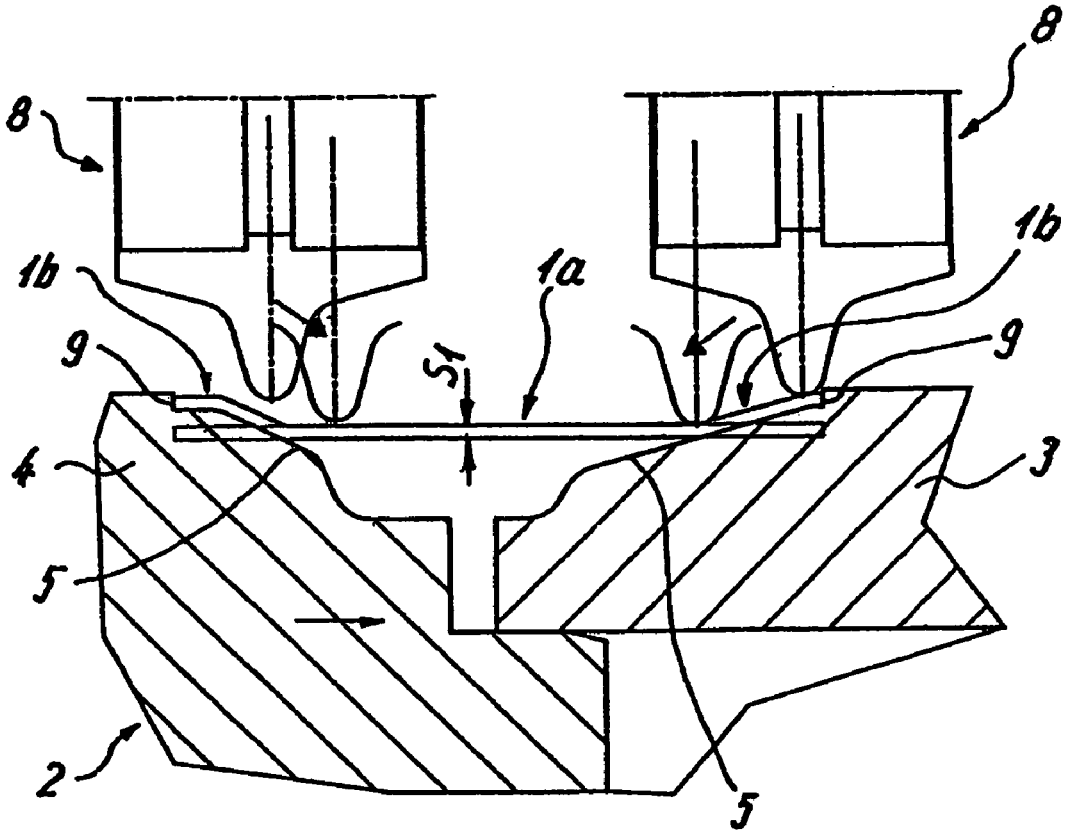
FIG. 5 is a longitudinal sectional view of another embodiment of a device for producing a pneumatic tire rim and illustrating a process step, according to the present disclosure.

FIG. 5 illustrates that the largest diameter of lining parts 3, 4 in a machining area 20 or in a contact area with the tube section 1*a*, is larger than an inside diameter of tube section 1*a*, so that the tube section 1*a*, which at first is cylindrical, rests with its end edges 18, 19 against assigned precontour 5 of the lining parts 3, 4.

During an axial mutual application of the lining parts 3, 4, the end areas 16, 17 of the tube section 1*a* are in each case deformed to a widening 1*b*.

As mentioned above, further machining, that is, contouring also in the end areas 16, 17, takes place by the pressure rollers 8.

Although the present disclosure has been described and illustrated in detail, it is to be clearly understood that this is done by way of illustration and example only and is not to be taken by way of limitation. The scope of the present disclosure is to be limited only by the terms of the appended claims.

The invention claimed is:

1. A method of producing a weight-optimized pneumatic tire rim having rotationally-symmetrically partially different wall thicknesses, the steps comprising:

providing a tube section having a first wall thickness and two terminal ends;

leveling the first wall thickness starting from the two terminal ends over a defined rotationally-symmetrical area thereby forming two flanks by precontouring, each of the flanks including one of the terminal ends and each flank having a second wall thickness, and pushing tolerance-caused excess material of the flanks into a well base zone between the two flanks, the well base zone having a third wall thickness;

contouring the flanks by pressure rolling while drawing each of the flanks toward their respective terminal ends and reducing the second wall thickness of each of the flanks with respect to the third wall thickness of the well base zone, the contouring beginning outside the well base zone; and wherein the second wall thicknesses vary according to predetermined measurements.

2. The method according to claim 1, wherein before the leveling of the first wall thickness, the tube section is widened on at least one of the terminal ends.

3. The method according to claim 1, wherein during the drawing, the flanks are pressed against a stop.

4. The method according to claim 1, wherein the precontouring of the flanks and leveling of the first wall thickness takes place by rolling.

5. The method according to claim 1, wherein the tolerance-caused excess material of the flanks is utilized to form a third wall thickness of the well base zone.

6. The method according to claim 1, further including a rim well and during the drawing, the rim well is shaped to a final contour.

7. The method of claim 6, wherein the rim well is produced by cold forming.

8. The method according to claim 1, wherein after the drawing, the terminal ends of the flanks are finished by shaping rollers.

9. The method of claim 1, wherein the tube section is cylindrical.

10. The method of claim 1, wherein prior to the contouring, further comprising the step of mounting the tube section into a perform including a pair of opposing stops.

11. The method of claim 10, wherein after the contouring, the tire rim lies between the opposing stops.

* * * * *